US008235664B2

(12) United States Patent
Carchedi

(10) Patent No.: US 8,235,664 B2
(45) Date of Patent: Aug. 7, 2012

(54) LINER IN A COOLING CHANNEL OF A TURBINE BLADE

(75) Inventor: Frank Carchedi, Branston (GB)

(73) Assignee: Siemens Aktiengesellschaft, München (DE)

( * ) Notice: Subject to any disclaimer, the term of this patent is extended or adjusted under 35 U.S.C. 154(b) by 573 days.

(21) Appl. No.: 12/515,096

(22) PCT Filed: Oct. 19, 2007

(86) PCT No.: PCT/EP2007/061193

§ 371 (c)(1),
(2), (4) Date: May 15, 2009

(87) PCT Pub. No.: WO2008/058827

PCT Pub. Date: May 22, 2008

(65) Prior Publication Data

US 2010/0247330 A1 Sep. 30, 2010

(30) Foreign Application Priority Data

Nov. 17, 2006 (EP) ..... 06023927

(51) Int. Cl.
*F01D 5/08* (2006.01)
*F01D 5/30* (2006.01)

(52) U.S. Cl. ..... 416/96 A; 416/248

(58) Field of Classification Search ..... 416/96 A, 416/96 R, 97 R, 248, 233; 415/115
See application file for complete search history.

(56) References Cited

U.S. PATENT DOCUMENTS

| | | | | |
|---|---|---|---|---|
| 2,836,391 | A | 5/1958 | Hayes | |
| 3,370,830 | A * | 2/1968 | Harper et al. | 416/95 |
| 3,446,480 | A * | 5/1969 | Emmerson et al. | 416/90 R |
| 3,610,769 | A * | 10/1971 | Schwedland et al. | 415/205 |
| 4,249,291 | A * | 2/1981 | Grondahl et al. | 29/889.722 |
| 4,259,037 | A | 3/1981 | Anderson | |
| 4,260,336 | A | 4/1981 | Johnson | |
| 5,259,730 | A | 11/1993 | Damlis et al. | |
| 6,453,557 | B1 * | 9/2002 | Burdgick | 29/889.722 |
| 6,709,771 | B2 | 3/2004 | Allister | |
| 6,811,378 | B2 * | 11/2004 | Kraft | 416/191 |
| 2005/0008780 | A1 * | 1/2005 | Ackerman et al. | 427/252 |
| 2005/0118024 | A1 | 6/2005 | Anguisola McFeat et al. | |

FOREIGN PATENT DOCUMENTS

| | | | |
|---|---|---|---|
| JP | 59150904 | A | 8/1984 |
| SU | 1615055 | A1 | 12/1990 |

* cited by examiner

*Primary Examiner* — Edward Look
*Assistant Examiner* — Jason Davis

(57) ABSTRACT

A turbine blade with a blade root, an aerofoil, at least one cooling passage arranged in the turbine blade and extending from the blade root to the aerofoil, and a liner arranged in the at least one cooling passage is provided. The liner protects the cooling passage against corrosion, especially type II hot corrosion.

15 Claims, 1 Drawing Sheet

LINER IN A COOLING CHANNEL OF A TURBINE BLADE

CROSS REFERENCE TO RELATED APPLICATIONS

This application is the US National Stage of International Application No. PCT/EP2007/061193, filed Oct. 19, 2007 and claims the benefit thereof. The International Application claims the benefits of European application No. 06023927.4 EP filed Nov. 17, 2006, both of the applications are incorporated by reference herein in their entirety.

FIELD OF THE INVENTION

The invention relates to the blade of a gas turbine engine and the resistivity against corrosion thereof in the root section.

BACKGROUND OF THE INVENTION

Many components in gas turbines are not only subject to thermal, mechanical and erosive stresses but also to corrosive influences to a considerable extent. Causes of corrosion can be found in the type and source of the fuel and the composition of the combustion air. The temperature in the corrosion exposed area is a contributing factor.

To protect against corrosion, blades are usually coated with either diffusion or overlay coating. These coatings are both expensive and at low temperature inductile which may cause cracking. The coating cracks can then create crack initiation sites for the base material leading to premature failure. Due to the lower temperature within the blade internal cooling passages this problem can be more acute.

SU 1615055 A1 describes a screw propeller, comprising a set of hub sectors made monolithic with blades. The hub is applied to a stainless steel corrosion prevention sleeve enclosing a propeller shaft.

US 2005/0118024 describes throughflow openings for a cooling medium in a coolable component. The throughflow opening comprises an insert that reduces the size of the first opening cross-section to a second opening cross-section, and that is released from the first opening if the second opening cross-section becomes blocked as a result of a local temperature rise and a thermally unstable joining between the insert and the component, being mounted in a first opening.

U.S. Pat. No. 6,709,771 B2 describes a hybrid component like a blade of a gas turbine engine that may be cast as monolithic structure with internal cooling channels. A single crystal airfoil forms part of a mould where a ceramic insert is positioned prior to filling the mould with powder metallurgy material. The ceramic insert defines during the casting process the cooling channels and is later dissolved to create the open cooling channels within the cast component.

SUMMARY OF THE INVENTION

An object of the invention is to provide a turbine blade cooling passage having substantially improved corrosion resistance, and thus increasing the service life of the component.

This objective is achieved by the claims. The dependent claims describe advantageous developments and modifications of the invention.

Usually internal corrosion is confined to the entry section of the cooling passages due to the lower temperatures which condense contaminants on the surface. An inventive turbine blade comprises a corrosion resistant liner inserted into the entry section of the cooling passage replacing the coating.

By such a design of the cooling passage an improved turbine blade with higher corrosion resistance is achieved.

It is particularly advantageous when the liner is arranged in an entry section of the cooling passage since that part is the farthest from the aerofoil being in contact with the hot medium gases. The lower temperature allows more contaminants to condense on the surface of the cooling passage and thus more corrosion occurs.

In a particular realisation the liner approximates the interior of the aerofoil thus protecting the cooling passage throughout the blade root and platform.

In a particular embodiment the liner is arranged as a loose part in the cooling passage. During refurbishment of the blade the liner can easily be exchanged.

In another embodiment the liner is cast into the turbine blade. The casting renders manufacturing tolerance less critical while adding up to an inherent sealing between liners and base material of the cooling passages, where the sealing protects against an incoming corrosive cooling medium.

It is particularly advantageous when the liner includes or is made of a corrosion resistant material like, for example, a material containing chromium, which is particularly appropriate to protect against type II hot corrosion.

In a particular realisation the liner is welded to the edge of the entry of the cooling passage to protect against the entry of corrosive cooling medium between the liner and the wall of the cooling passage.

In another particular realisation the liner is swaged into the entry section of the cooling passage to protect the wall of the cooling passage entry section against direct exposure to the cooling medium.

In a further advantageous implementation the transition from the liner to the blade root material at the far end, relative to the entry of the cooling channel, is smooth to optimize the transition from liner to cooling channel base material regarding flow resistance and sealing properties.

To keep the mechanical load on the blade exerted by the liner during operation small, it is advantageous to reduce the mass of the liner. The liner wall thickness should therefore be small compared to the hydraulic diameter of the liner. In an embodiment with a hydraulic diameter of 5 to 7 mm, the liner wall thickness will therefore be of the order of 0.5 to 1 mm, in other words, the ratio of the hydraulic diameter to the wall thickness is in the range between 5:1 and 14:1. Ranges between 5:1 and 20:1 or 2:1 and 20:1 are also conceivable. For larger gas turbine engines the ratio will even be in the range between 2:1 and 100:1.

BRIEF DESCRIPTION OF THE DRAWINGS

The invention will now be further described, with reference to the accompanying drawings in which.

Figure 1:
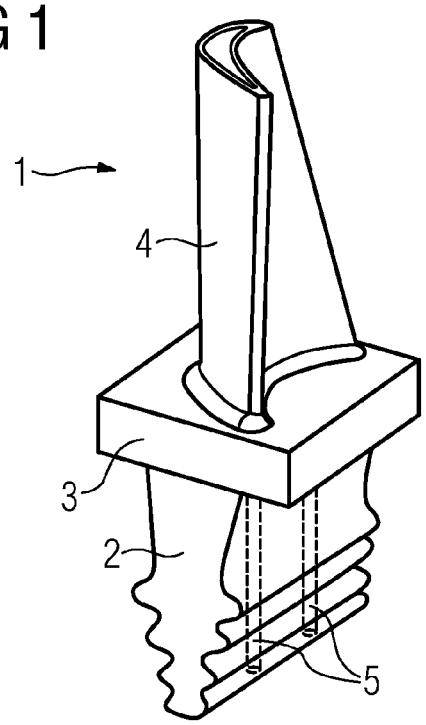
FIG. 1 is a perspective view of a turbine blade.

In the drawings like references identify like or equivalent parts.

DETAILED DESCRIPTION OF THE INVENTION

Referring to the drawings, FIG. 1 is a perspective view of a turbine blade 1. The turbine blade 1 comprises a blade root 2, an adjoining platform 3 and an aerofoil 4. During operation, the aerofoil 4 is subjected to the flow of hot working medium gases which makes it usually necessary to provide cooling to the turbine blades 1. To remove heat from the turbine blades 1, cooling air is bled from the engine's compressor and directed into cooling passages 5 within the disc and turbine blade 1 interiors. The turbine blade 1 in FIG. 1 has, as an example, two of these cooling passages 5.

Figure 2:
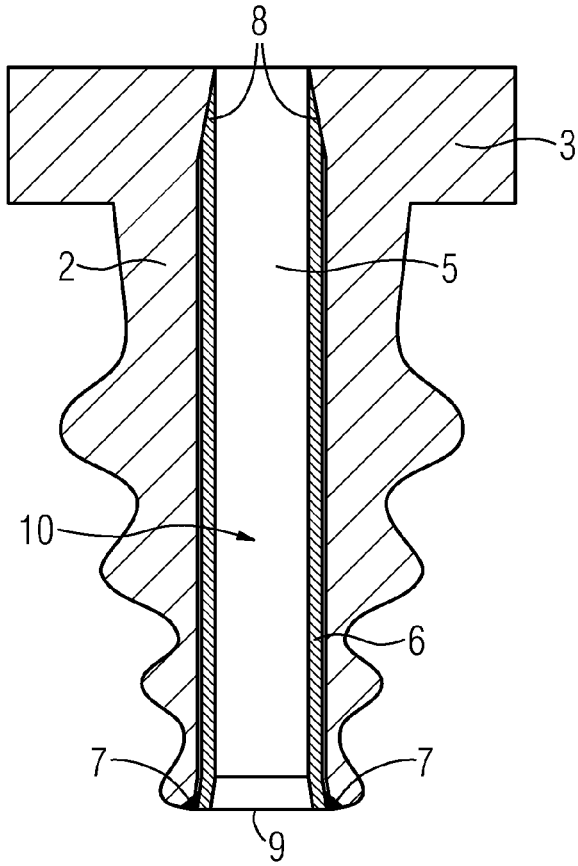
FIG. 2 is showing a partial section of a blade root.

The section view of FIG. 2 is showing an internal cooling passage 5 of a blade root 2 through a plane passing through the centre (mid chord section) of a cooling passage 5. Even if the blade root 2 shown in FIG. 2 is of fir-tree configuration, the invention applies also to other configurations, like for example hammerhead, dovetail or bulb roots. For the sake of convenience and simplicity only one cooling passage 5 is shown. Of course, the inventive concept can be applied to more than one cooling passage 5 per blade root 2. A corrosion resistant liner 6 extends from an entry 9 of the cooling passage 5 to the platform 3 thus covering the surface of the entry section 10 of the cooling passage 5. The liner wall thickness is smaller than the hydraulic diameter of the liner. The shape of the liner 6 depends on the shape of the cooling passage 5. A seal 7 is arranged at the entry 9 of the cooling passage 5, to keep corrosive cooling medium from entering the cooling passage 5 between the liner 6 and the surrounding wall of the cooling passage 5 in the blade root 2. The far end of the liner 6 is tapered to form a smooth transition 8 to the cooling passage 5.

What is claimed is:

1. 1 A turbine blade comprising:

a blade root;

an aerofoil;

a cooling passage arranged in the turbine blade configured to receive cooling air from a compressor and extending from the blade root through the aerofoil, the cooling passage comprising an entry section extending toward the aerofoil, wherein the entry section is shorter than the cooling passage; and a liner limited to the entry section, wherein the liner protects the entry section against corrosion, wherein the liner comprises a tapered end effective to provide a smooth transition from the entry section to a remainder of the cooling passage.

2. The turbine blade as claimed in claim 1, wherein the liner is a separate part arranged in the cooling passage.

3. The turbine blade as claimed in claim 1, wherein the liner is cast into the turbine blade.

4. The turbine blade as claimed in claim 1, wherein the liner includes a corrosion resistant material.

5. The turbine blade as claimed in claim 4, wherein the corrosion resistant material includes chromium.

6. The turbine blade as claimed in claim 4, wherein the corrosion resistant material protects against a type II hot corrosion.

7. The turbine blade as claimed in claim 1, wherein a seal is arranged between an entry opening of the cooling passage and the liner.

8. The turbine blade as claimed in claim 7, wherein the seal is a weld.

9. The turbine blade as claimed in claim 7, wherein the liner is swaged into the entry section of the cooling passage.

10. The turbine blade as claimed in claim 1, wherein a ratio of a hydraulic diameter of the liner to a liner wall thickness is in a range between 2:1 and 100:1.

11. The turbine blade as claimed in claim 10, wherein the ratio is in the range between 2:1 and 20:1.

12. The turbine blade as claimed in claim 10, wherein the ratio is in the range between 5:1 and 20:1.

13. The turbine blade as claimed in claim 10, wherein the ratio is in the range between 5:1 and 14:1.

14. The turbine blade as claimed in claim 1, wherein the liner is welded to an edge of the entry opening.

15. The turbine blade as claimed in claim 1, wherein the entry section ends within a platform disposed between the blade root and the aerofoil.

* * * * *